US006093513A

United States Patent [19]

Takeda et al.

[11] Patent Number: 6,093,513

[45] Date of Patent: Jul. 25, 2000

[54] PHOTORECEPTOR FOR ELECTROPHOTOGRAPHY AND METHOD OF MANUFACTURING THE SAME

[75] Inventors: Yoshinobu Takeda; Hiroyuki Endoh; Tsutomu Uezono, all of Tokyo, Japan

[73] Assignee: NEC Corporation, Tokyo, Japan

[21] Appl. No.: 09/295,407

[22] Filed: Apr. 21, 1999

[30] Foreign Application Priority Data

Apr. 21, 1998 [JP] Japan ..... 10-110519

[51] Int. Cl.[7] ..... G03G 5/047; G03G 5/147

[52] U.S. Cl. ..... 430/67; 66/132

[58] Field of Search ..... 430/66, 67, 132

[56] References Cited

U.S. PATENT DOCUMENTS

| | | | |
|---|---|---|---|
| 4,472,491 | 9/1984 | Wiedemann | 430/67 |
| 4,477,548 | 10/1984 | Harasta et al. | 430/132 |
| 4,606,934 | 8/1986 | Lee et al. | 430/67 |
| 4,917,980 | 4/1990 | Badesha et al. | 430/66 |

FOREIGN PATENT DOCUMENTS

| | | | |
|---|---|---|---|
| 0 798 599 | 10/1997 | European Pat. Off. . | |
| 56-69641 | 6/1981 | Japan | 430/132 |
| 3-129360 | 6/1991 | Japan . | |
| 8-160640 | 6/1996 | Japan . | |
| 9-100111 | 4/1997 | Japan . | |
| 9-325509 | 12/1997 | Japan . | |

*Primary Examiner*—Roland Martin

[57] ABSTRACT

Disclosed herein is a photoreceptor for electrophotography having an over coating layer formed on a substrate and prepared by applying a composition containing silica particles, an organic compound chemically bonded thereto and a photo polymerization initiator and by curing said composition; said organic compound having an polymerizable unsaturated group, a group designated by Formula (1) or a group designated by Formula (2), and said silica particles and said organic compound being bonded with each other through a silyloxy group. The photoreceptor for electrophotography has not only excellent durabilities and an excellent resistance to printing but also excellent electrophoto characteristics such as sensitivity and a residual potential.

Formula (1)

Formula (2)

(wherein —X— is selected from —NH—, —O— and —S—, —Y— is an oxygen atom or a sulfur atom, and when —X— is —O—, Y is said sulfur atom).

7 Claims, 3 Drawing Sheets

PHOTORECEPTOR FOR ELECTROPHOTOGRAPHY AND METHOD OF MANUFACTURING THE SAME

BACKGROUND OF THE INVENTION (a) Field of the Invention

The present invention relates to a photoreceptor for electrophotography having an over coating layer, and more in particular to the photoreceptor for electrophotography employed in a copying machine and a printer using an electrophotographic recording method.

(b) Description of the Related Art

Recently, organic photoconductive material has been widely employed as a photoreceptor for electrophotography because of its advantages such as width of material selection and high productivity. The photoreceptor for electrophotography employing the organic photoconductive material is utilized as a function-separating photosensitive material consisting of a charge generation layer and a charge transport layer layered with each other.

The photoreceptor for electrophotography is naturally required to have a specified sensitivity, electrical characteristics and optical characteristics depending on an electrophotographic process in which the above photoreceptor for electrophotography is employed. Since an electrical or mechanical force such as that produced in corona charging, toner development, transfer to paper and a cleaning treatment is directly applied on a surface layer of the photoreceptor for electrophotography which can be repeatedly employed, the surface layer is required to have high durabilities against the above force. Due to deterioration produced by ozone generating during the corona charging, the specific durabilities are required in connection with electrical characteristics against sensitivity decrease, potential decrease and residual potential increase or those in connection with mechanical characteristics against abrasion and scratches of the sensitive material generated by its sliding.

Conventionally, in order to elevate the mechanical durabilities, the employment of thermosetting or photosetting resin as an over coating layer of the sensitive material is disclosed (for example, in Patent Publication No. JP-A-1996-160640, this disclosure will be hereinafter referred to as "Prior Art 1"). In accordance with Prior Art 1, a photoreceptor for electrophotography having excellent hardwearing properties and environmental resistances can be provided by employing a protective layer having electroconductive metal oxide particles dispersed in resin obtained by polymerization between a photo-setting acryl monomer and an oligomer, and a photo-polymerization initiator.

Various coating materials are also known which are applied to that other than the sensitive materials. For example, a curable composition having reactive silica and a polymerizable unsaturated group employed as a hard coating material such as a plastics optical component, a touch panel and glass is disclosed in Patent Publication No. JP-A-1997-100111 (Title of Invention: "Reactive Silica, its Preparation and Usage", this disclosure will be hereinafter referred to as "Prior Art 2").

A coating film having a resistance to scuffing, weatherability, adherence and curability and satisfying properties from transparence to translucence and from high glossiness to dullness can be formed on various substrates in accordance with Prior Art 2. These are useful especially for a protective coating having a resistance to scuffing and weatherability present on the surface of organic resin mold, and also useful for a coating material applicable to a plastic substrate of which a heat resistant property is poor.

However, the coating material employing the thermosetting over coating layer requires a thermal treatment at a high temperature for a long period of time, and this material cannot be used depending on a kind of an organic photoconductive material and a substrate material. Moreover, a further period of time of the thermal treatment is required for sufficiently curing the coating material in order to produce a hardness and a resistance to printing sufficient for the over coating layer and to stabilize the electrophoto characteristics resulting in the elevation of the manufacturing cost.

When the photo-setting over coating layer of Prior Art 1 is employed, a photo-isomerization reaction and a photodecomposition reaction may occur in the organic photoconductive material by means of an ultraviolet ray which is necessary for the curing to lower the electrophoto characteristics.

In case of a contact development system in which toner is rubbed and adhered to the sensitive material at a development part to perform the development, the resistance to printing and the resistance to scuffing are insufficient if only the curable resin is employed in the over coating layer.

In Prior Art 1, the metal particles are dispersed to elevate the electrophoto characteristics, but the metal particles are likely to be peeled off by repeated developments, and the peeled-off part disadvantageously produces an image defect.

When, on the other hand, the coating material of Prior Art 2 which is highly resistant is employed as the over coating layer of the photoreceptor for electrophotography, the electrophoto characteristics are largely deteriorated not to put the material in practice.

In order to prepare the over coating layer having the resistance to printing, the hardwearing property and the resistance to scuffing in the practical use which is employed in the photoreceptor for electrophotography of the contact development system, the over coating layer having a thickness thicker than the coating film of the conventional plastics optical component is requested. However, a thick film prepared by employing a conventional thermosetting and photosetting paint is difficult to be obtained because the paint is contracted at the time of curing. The realization of the film thickness satisfying not only the electrical characteristics of the sensitive material or the electrophoto characteristics but also the high resistance to printing and the high resistance to scuffing is extremely difficult.

SUMMARY OF THE INVENTION

It is therefore an object of the present invention to provide a photoreceptor for electrophotography having not only excellent electrophoto characteristics but also a high resistance to printing and a high resistance to scuffing, and a method for manufacturing the same.

The present invention provides a photoreceptor for electrophotography comprising: a substrate, and an over coating layer layered thereon and prepared by applying a composition containing silica particles, an organic compound chemically bonded thereto and a photo polymerization initiator and by curing the composition; the organic compound having at least one group selected from a group consisting of a polymerizable unsaturated group, a group designated by Formula (1) and a group designated by Formula (2), and the silica particles and the organic compound being bonded with each other through a silyloxy group.

Formula (1)

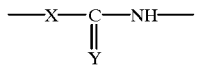

Formula (2)

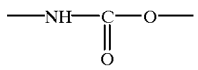

(In these Formulae, —X— is selected from —NH—, —O— and —S—, —Y— is an oxygen atom or a sulfur atom, and when —X— is —O—, Y is the sulfur atom)

In accordance with the present invention, the photoreceptor for electrophotography is obtained which is excellent not only in durabilities against ozone and photo-fatigue and a resistance to printing by means of paper or a cleaning blade but also in electrophoto characteristics such as sensitivity and a residual potential.

PREFERRED EMBODIMENTS OF THE INVENTION

Figure 1:
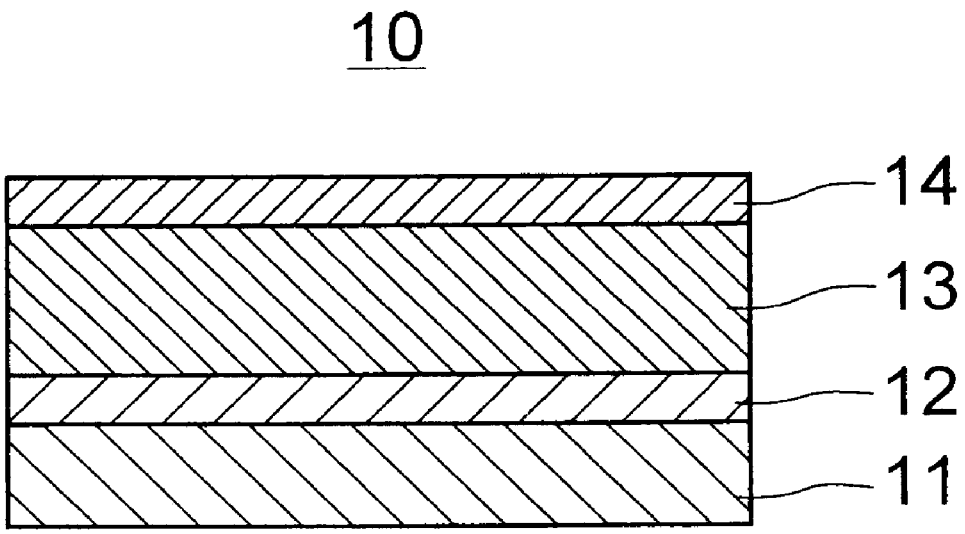
FIG. 1 is a sectional view showing a layered photoreceptor for electrophotography which is an Embodiment of the present invention.

Since, in the invention of claim 1, silica particles excellent in a resistance to printing and an organic compound employed as a curing agent are bonded with each other in an over coating layer coating material, an over coating layer excellent in the durability and in the resistance to printing can be obtained. Since the over coating layer coating material containing a photo-polymerization initiator is employed and the coating material is cured by employing an ultraviolet ray having a specified wavelength, a time length for the manufacture can be remarkably shortened compared with that for the manufacture of an over coating layer employing a thermosetting coating material. Further, thermal deterioration of performances of an organic photoconductive material and of a substrate at a time of curing which is a problem of the thermal curing can be prevented. Since the thermal setting and photo-setting materials excellent in the resistance to printing and the resistance to scuffing are largely contracted, a thick film having a thickness of 1 $\mu$m or more required for the over coating layer of the organic sensitive material employed in a conventional contact development is difficult to be prepared. The over coating layer formed as a uniform and thick film of 1 $\mu$m or more excellent in the resistance to printing and the resistance to scuffing can be prepared because the contraction at the time of curing can be made small by making a bonding among the silica particles and the organic compound which is a main curing component.

The invention of claim 2 exhibits similar effects to those of the invention of claim 1. In addition, the charge transport material between 0.01 and 10% of the protective layer is contained therein. By this incorporation of the charge transport material, the electrophoto characteristics lowered by the over coating layer having no added charge transport material can be improved. To adduce examples, the sensitivity is elevated, and the residual potential is reduced. As a result, the photoreceptor for electrophotography can be realized having the excellent electrophoto characteristics and durabilities.

Conventionally, metal particles are dispersed in order to improve the electrophoto characteristics of the photoreceptor for electrophotography having the over coating layer. Because of this dispersion, the metal particles are likely to be peeled off by repeated developments, and the peeled-off part disadvantageously produces an image defect.

However, in the invention of claim 2, the strength unevenness in the over coating layer is removed by adding the charge transport material having good compatibility with the resin in the over coating layer. As a result, the partial peeling-off of the over coating layer is prevented so as to effectively depress the generation of the image default.

The invention of claim 3 exhibits similar effects to those of the inventions of claims 1 and 2. In addition, the thickness of the over coating layer is made to be between 0.5 and 10 $\mu$m. Not only the elevation of the resistance to printing and of the durability but also the suitable electrophoto characteristics in the practical range can be realized by layering the over coating layer on the organic sensitive material.

Since, in the invention of claim 4, the composition mainly containing the silica particles, the organic compound chemically bonded thereto and the photo-polymerization initiator is diluted by and dispersed in a solvent of which a main component is water or an alcohol having a boiling point of 120° C. or less in a specified concentration range to prepare the photosetting coating material that is applied and cured to form the over coating layer, the over coating layer can be prepared depressing the influence of the solvent to the charge generation layer and to the charge transport layer that are primary coats for the preparation. In other words, the over coating layer can be prepared without dissolution and crystallization of the charge transport material and crystal transfer of the charge generation layer by employing the solvent of which the main component is the alcohol or the water. By making the boiling point of the solvent for the dilution and the dispersion to be 120° C. or less, the lowering of the characteristics due to the residual solvent can be prevented, and the drying treatment can be conducted in an industrially safe and practical temperature range which does not effect a thermal influence to the sensitive material layer to elevate the productivity. Since the alcohol or the water is employed, the environmental safety and the relatively easy treatment can be secured and the environmental problems recently recognized are suitably avoidable.

The invention of claim 5 exhibits similar effects to those of the invention of claim 4. Isopropyl alcohol is excellent in wettability and is suitable for applying a thin film employed for the over coating layer to a large area. By mixing the isopropyl alcohol with methanol excellent in the dispersing ability of the composition mainly containing the silica particles, the organic compound chemically bonded thereto and the photo-polymerization initiator, the coating material can be stably preserved to reduce the drying speed in the preparation of the over coating layer compared with the case only isopropyl alcohol is employed. Since the isopropyl alcohol makes an azeotropic mixture with water to remove the water at a low temperature, moisture affecting the electrophoto characteristics is not left at the preparation of the over coating layer for stabilizing the manufactured sensitive material as well as for preventing the lowering of the above characteristics. Because of this reason, the photoreceptor for electrophotography having the excellent electrophoto characteristics and the excellent durabilities can be prepared without dissolution and crystallization of the charge transport material and crystal transfer material.

In the invention of claim 6, the organic solvent dissolves a relatively large amount of the charge transport material. The solvent dissolving the charge transport material is diluted with the alcoholic solvent to prepare the over coating layer coating material by further dispersing the photo-setting coating material therein. By uniformly dissolving the charge transport material which hardly dissolves in the photo-setting coating material followed by the application and the curing in accordance with the above procedures, the charge transport material is uniformly dispersed in the over coating layer without precipitation to prepare the sensitive material without clouding.

In the invention of claim 7, for the curing of the over coating layer coating material, an ultraviolet ray having a wavelength of mainly 310 nm or less, especially 254.7 nm and 184.9 nm, is employed. That is, the ultraviolet ray is absorbed at the neighborhood of the surface of the over coating layer by employing that having a high absorption coefficient concerning the organic material.

Since a photo-isomerization reaction or a photo-decomposition reaction occurs in the organic material by the irradiated ultraviolet ray, the deterioration, the lowering of the performances and the photo-memory effect of the organic sensitive material are generated when the photo-setting coating material is employed. On the contrary, in the invention of claim 7, the lowering of the performances of the organic sensitive material due to the ultraviolet ray is prevented by absorbing the ultraviolet ray at the neighborhood of the organic sensitive material at the time of the curing of the photo-setting coating material, and consequently the photoreceptor for electrophotography having the excellent electrophoto characteristics and the excellent durability can be prepared.

The invention of claim 8 exhibits similar effects to those of the inventions of claims 6 and 7. Further, the photoreceptor for electrophotography having the excellent durability, resistance to printing and electrophoto characteristics can be effectively prepared at a high yield. As a result, the photoreceptor for electrophotography having the highly durable over coating layer can be obtained in a simple method and at a low cost.

The invention of claim 9 exhibits similar effects to those of the inventions of claims 2 and 6, and the invention of claim 10 exhibits similar effects to those of the inventions of claims 2 and 8.

Since, in the invention of claim 11, the first organic solvent is tetrahyrdofuran (THF), the charge transport material can be dissolved therein at a high concentration. Since the dilution with the alcoholic solvent is easily performed, the THF is employed as an over coating layer coating material which stably dissolves the charge transport material after the dilution by diluting the THF dissolving the charge transport material with the alcoholic solvent. When the charge transport material is dissolved in the photo-setting coating material diluted with the methanol and the isopropyl alcohol, the dispersion and the dilution can be performed without the precipitation of the composition to stably prepare the over coating layer coating material.

Since, in the invention of claim 12, the second organic solvent is methanol, the composition of the photo-setting coating material is not precipitated and easily mixed with the THF so as to stably prepare the over coating layer coating material.

The polymerizable unsaturated group contained in the organic compound includes, for example, an acryloxy group, a methacryloxy group, a vinyl group, a propenyl group, a butadienyl group, a styryl group, an ethynyl group, a cinnamoyl group, a maleate group and an acrylamide group, and an acryloxy group is especially desirable.

Examples of a group designated by the above Formula (1) include groups identified by the below Formulae(3).

Formulae(3)

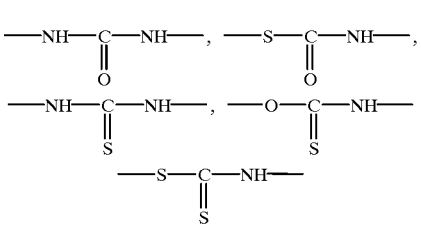

Examples of an organic compound having a group designated by the above Formula (1) include those identified by the below formulae.

Formulae(4)

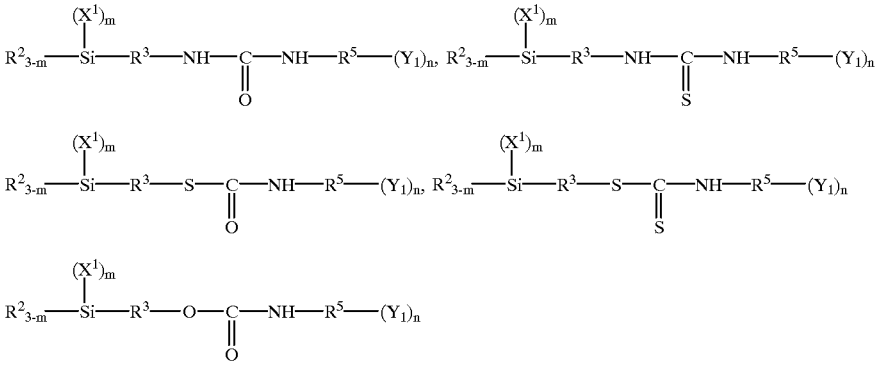

-continued

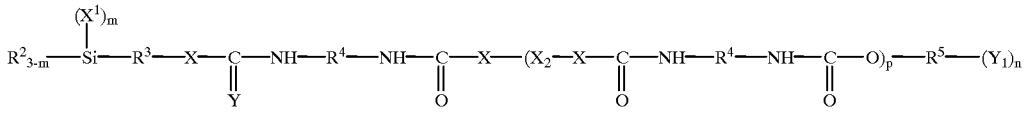

In these formulae, $X^1$ is an alkoxyl group, a carboxylate group, a halogen atom, an amino group, an oxime group or a hydrogen atom, and $R^2$ is a hydrogen atom or a monovalent organic group having 1 to 8 carbon atoms such as an alkyl group, an aryl group and an aralkyl group or a non-hydrolyzable organic group comprised of a carbon atom, an oxygen atom and a hydrogen atom.

The alkoxyl group designated by the above $X^1$ includes, for example, a methoxy group, an ethoxy group, an isopropoxy group, a butoxy group, a phenoxy group and an octyloxy group. The carboxylate group includes, for example, an acetoxy group, and the halogen atom includes, for example, iodine, chlorine, bromine and fluorine. The amino group includes, for example, a monoalkylamino group such as a non-substituted amino group and a methylamino group and a dialkylamino group such as a dimethylamino group and a diethylamino group.

The oxime group includes methylene oxime and dimethylmethylene oxime. In the above formulae, "m" is 1, 2 or 3. Among these, the alkoxyl group is especially desirable.

The alkyl group designated by the above $R^2$ includes, for example, a methyl group, an ethyl group, a propyl group, a butyl group and an octyl group, and the aryl group includes, for example, a phenyl group, a tolyl group, a xylyl group and a p-methoxyphenyl group. The aralkyl group includes, for example, a benzyl group and a phenylethyl group, and the non-hydrolyzable organic group comprised of the carbon atom, the oxygen atom and the hydrogen atom includes, for example, a 2-methoxyethyl group, a 2-ethoxyethyl group and a 2-butoxyethyl group.

A hydrolyzable silyl group defined by the combination of the above $X^1$ and $R^2$ preferably includes, for example, a trimethoxysilyl group, a triethoxysilyl group, a triisopropoxysilyl group, a methyldimethoxysilyl group and a dimethyldimethoxysilyl group.

The above $R^3$ is selected from bivalent organic groups having an aliphatic or aromatic structure having 1 to 12 carbon atoms, and the structure may contain a chain, branched or cyclic structure. Such a structural unit includes, for example, methylene, ethylene, propylene, methylethylene, butylene, methylpropylene, cyclohexylene, phenylene, 2-methylphenylne, 3-methylphenylne, octamethylene, biphenylene and dodecamethylene. Among these, the methylene, the propylene, the cyclohexylene and the phenylene are especially preferable.

The above $R^4$ is a bivalent organic group having an aliphatic or aromatic structure and its structure may contain a chain, branched or cyclic structure. Such a structural unit can be selected from a group consisting of a bivalent organic group having a chain skeleton structure which includes, for example, methylene, ethylene, propylene, tetramethylene, hexamethylene, 2,2,4-trimethylhexamethylene and 1-(methylcarboxyl)-pentamethylene, a bivalent organic group having an alicyclic skeleton structure which includes, for example, isophorone, cyclohexylmethane, methylene bis(4-cyclohexane), hydrogenated diphenylmethane, hydrogenated xylene and hydrogenated toluene, and a bivalent organic group having an aromatic skeleton structure which includes, for example, benzene, toluene, xylene, paraphenylene, diphenylmethane, diphenylpropane and naphthalene.

The above $X^2$ is a bivalent organic group, and more in particular is a bivalent organic group derived from a compound having, in the molecule, two or more active hydrogen atoms which undergo an addition reaction to an isocyanate group or a thioisocyanate group. Examples of this bivalent organic group include, for example, that derived by removing two HX- groups from polyalkylene glycols, polyalkylene thioglycols, polyesters, polyamides, polycarbonates, polyalkylene diamines, polyalkylene dicarcoxylic acids, polyalkylene diols and polyalkylene dimercaptanes.

The above "p" is a number of 0, 1 or more, and preferably 1 to 10. When "p" exceeds 10, viscosity of hydrolyzable silane modified by a polymerizable unsaturated group tends to be higher and it becomes intractable.

The above $R^5$ is an organic group having a valency of (n+1) and is selected from, for example, a chain, branched or cyclic saturated hydrocarbon group, an unsaturated hydrocarbon group and an alicyclic organic group, and "n" is selected from 1 to 20, and preferably from 1 to 10, and more preferably 3 to 5.

The above $Y^1$ is a monovalent organic group having a polymerizable unsaturated group undergoing an intermolecular crosslinking reaction under existence of an active radical species. Such a group includes, for example, an acryloxy group, a methacryloxy group, a vinyl group, a propenyl group, a butadienyl group, a styryl group, an ethynyl group, a cinnamoyl group, a maleate group and an acrylamide, and among these groups, an acryloxy group is especially desirable.

A photo-polymerization initiator is preferably selected from compounds generating an active radical species by means of ultraviolet ray irradiation, and 0.1 to 10 weight parts thereof, preferably 1 to 5 weight parts is formulated in 100 weight parts of a solid component of the curable composition.

Examples of the photo-polymerization initiator includes 1-hydroxy cyclohexyl phenyl ketone, 2,2-dimethoxy-2-phenyl acetophenone, xanthone, fluorenone, benzaldehyde, fluorene, anthraquinone, triphenylamine, carbazol, 3-methyl acetophenone, 4-chloro acetophenone, 4,4'-dimethoxy acetophenone, 4,4'-diamino benzophenone, Michler's ketone, benzoisopropyl ether, benzoin ethyl ether, benzyl dimethyl ketal, 1-(4-isopropylphenyl)-2-hydroxy-2-methylpropan-1-one, 2-hydroxy-2-methyl-1-phenylpropane- 1-one, thioxanthone, diethyl thioxanthone, 2-isopropyl thioxanthone, 2-chloro thioxanthone, 2-methyl-1-[4-(methylthio)phenyl]-2-morpholinopropan-1 -one and 2,4,6, -trimethyl benzoyl diphenyl phosphine oxide. However, any material which generates an active radical by light can be employed, and the photo-polymerization initiator is not restricted thereto.

Now, the present invention is more specifically described with reference to accompanying drawings.

Embodiment 1

Referring to FIG. 1, a multi-layered photoreceptor for electrophotography 10 is formed by an electroconductive substrate 11, a charge generation layer 12, a charge transport layer 13 and an over coating layer 14 layered in this turn. The electroconductive substrate 11 functions as a support for the other layers in addition to as an electrode of the photoreceptor for electrophotography, and the shape thereof may be any form such as cylindrical, planar and film-like. The material of the substrate 11 is not especially restricted and may be a metal such as aluminum, stainless steel and nickel. The substrate 11 may be a composite formed by an insulation substrate made by glass or plastics and an electroconductive film such as an aluminum or gold vapor deposition film and an electroconductive polymer coat, applied thereon.

The charge generation layer 12 is formed by a vapor deposition film of an organic photoconductive substance and a coating film prepared by dispersing an organic charge generation substance in binder resin in which a charge is generated when a charge generation material receives irradiated light having a specified wavelength. The charge generation substance preferably has electrical characteristics such as a high charge generation efficiency for a wavelength of light employable as a light source and a high charge injection efficiency for the charge generation substance employed as the charge transport layer. The charge generation substance includes a phthalocyanine compound such as metal-free phthalocyanine, copper phthalocyanine and titanium oxide phthalocyanine, and a pigment such as various azo pigments and quinone pigments, and the material thereof is suitably selected depending on the wavelength of the light source and the charge transport substance employed. Since the charge generation layer 12 absorbs the light from the light source to generate a sufficient amount of charge for counteracting a charge on the sensitive material generated by the corona discharge or the like, the film thickness of the charge generation layer 12 is determined by such a factor as an absorptivity coefficient of the charge generation substance, an amount of the charge generation substance dispersed in the binder resin and a generation efficiency. The thickness is generally 3 $\mu$m or less, and preferably between 0.1 and 1 $\mu$m.

The charge transport layer 13 is a coat or the like formed by a material such as an organic charge transport substance dispersed in the binder resin. The charge transport layer 13 functions as an insulation layer in dark, and has a role of retaining a charge produced by the corona discharge on the surface of the sensitive material. The charge transport layer 13 has a function of permeating the light induced by the charge generation layer 12 therethrough and transfers a charge generated in the charge generation layer 12 and injected thereto at the time of exposure to neutralize and extinguish the charge on the surface of the sensitive material. An organic compound such as a hydrazone compound, a triphenylmethane compound, a triphenylamine compound and a butadiene compound is employed as the charge transport material.

Polycarbonate resin, polyester resin, polyamide resin, polyurethane resin, silicon resin and epoxy resin are employed as the binder resin, which are required to have a mechanical durability, a chemical stability, an electrical stability, an adhesion property with other layers and a compatibility with the charge transport material employed. The thickness of the charge transport layer 13 is determined considering a charge retention rate, a charge transport speed and the mechanical durability, and is generally 50 $\mu$m or less and preferably between 10 and 30 $\mu$m.

The over coating layer 14 elevates the durability and the resistance to printing of the sensitive material. The layer 14 can sufficiently endure a mechanical friction produced by, for example, cleaning, and has a function of retaining a charge on the surface generated by the corona discharge or the like in dark and a property of permeating light induced by the charge generation layer 12.

The charge transport material is added to the over coating layer 14 for elevating the electrophoto characteristics by lowering the electrical resistance of the over coating layer. The charge transport material added to the over coating layer may be a similar material to that conventional employed. An organic compound such as a hydrazone compound, a triphenylmethane compound, a triphenylamine compound, a bis-triphenylamine styryl compound and a butadiene compound is employed as the charge transport material. Among these compounds, the triphenylamine compound and the bis-triphenylamine styryl compound are suitable which are hardly decomposed or isomerized by the irradiation of an ultraviolet ray.

Although the multilayered photoreceptor for electrophotography 10 which consists of the electroconductive substrate 11 made of, for example, aluminum, the charge generation layer 12, the charge transport layer 13 and the over coating layer 14 applied and layered in this turn has been described as one Embodiment, the structure of the photoreceptor for electrophotography of the present invention is not restricted thereto. For example, another structure in which a positively charged sensitive material consisting of the charge transport layer 13, the charge generation layer 12 and the over coating layer 14 are layered in this turn on the electroconductive substrate 11 is included in the present invention. The charge generation material can be dispersed in the photosetting resin to make the charge generation layer whether it is positively charged or negatively charged. A single layer sensitive material is also included in the present invention which is manufactured by applying a coating material obtained by mixing silica particles, an organic compound chemically bonded thereto, a photopolymerization initiator, a charge transport material and a charge generation material on the aluminum substrate and curing the same.

Figure 2:
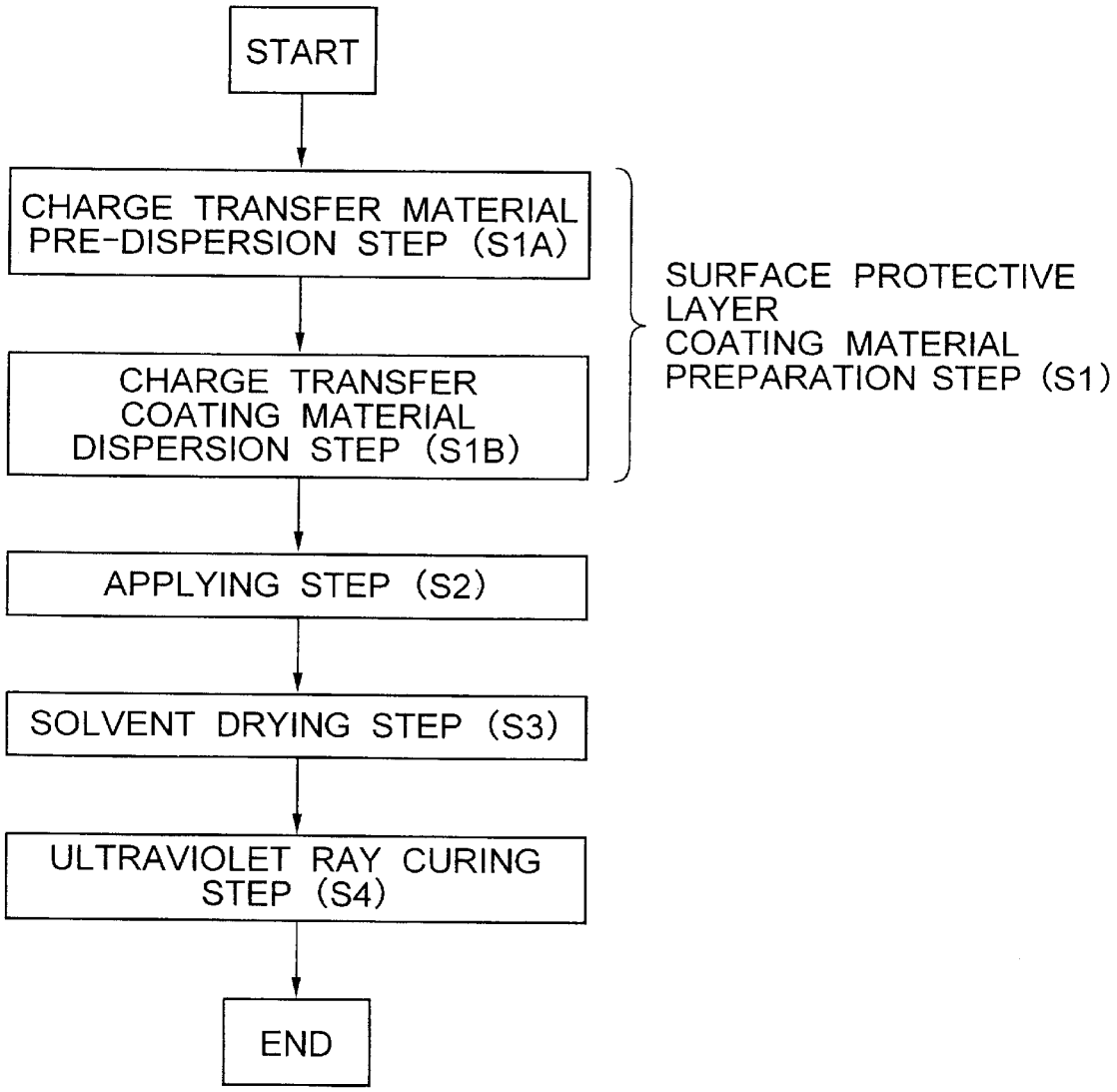
FIG. 2 is a flow chart showing one example of a method for manufacturing an over coating layer of the photoreceptor for electrophotography of the present invention.

Then, the over coating layer of the present invention will be described in detail in accordance with manufacturing procedures shown in FIG. 2.

In the method of manufacturing the over coating layer, for a purpose of elevating the electrophoto characteristics, a proper quantity of the charge transport material is added to the over coating layer. In order to determine the proper quantity of the charge transport material added to the over coating layer, an over coating layer coating material preparation step S1, an applying step S2, a solvent drying step S3 and an ultraviolet ray curing step S4 are conducted in this turn. The over coating layer coating material preparation step S1 are formed by a charge transport material pre-dispersion step S1A and a charge transport coating material dispersion step S1B.

In the charge transport material pre-dispersion step S1A, the charge transport material is dissolved in a first organic solvent which can be diluted in an organic solvent contained in a photo-setting coat stock solution and in which 10% or more of the charge transport material added to the over coating layer can be diluted, to prepare a thick solution of the charge transport material. Thereafter, in the charge transport coating material dispersion step S1B, the above thick solution is dispersed and diluted in a second organic solvent in which the charge transport material is difficult to be dissolved and which can be diluted in an organic solvent contained in the photo-setting coat, and the photo-setting coat stock solution is dispersed and diluted in the second organic solvent to prepare an over coating layer coating material.

An organic solvent for diluting and dispersing a composition mainly containing silica particles, an organic compound chemically bonded thereto and a photo-polymerization initiator in a photo-setting coating material stock solution includes, for example, a solvent such as methanol, ethanol, isopropyl alcohol, 2,2-dimethyl-1-propanol, n-butyl alcohol, 2-pentanol, 2-methyl-2-butanol, ethylene glycol, ethylene glycol monopropyl ether, methyl ethyl ketone, methyl isobutyl ketone, toluene, xylene and dimethyl formamide, and a mixture consisting of these solvents and an organic solvent compatible therewith, and that consisting of these solvents and water.

An organic solvent for diluting and dispersing the composition preferably includes alcohols having a boiling of 120° C. or less. These alcohols include methanol, ethanol, isopropyl alcohol, 2,2-dimethyl-1-propanol, n-butyl alcohol, 2-pentanol and 2-methyl-2-butanol. By employing the solvent of which a main component is the alcohol or the water, the over coating layer can be prepared while depressing the influence of the solvent to the charge generation layer and to the charge transport layer which act as primary coats. In other words, the over coating layer can be prepared without dissolution and crystallization of the charge transport material and crystal transfer of the charge generation layer by employing the solvent of which the main component is the alcohol or the water.

By making the boiling point of the solvent for the dilution and the dispersion to be 120° C. or less, the lowering of the characteristics due to the residual solvent can be prevented, and the drying treatment can be conducted in an industrially safe and practical temperature range which does not effect a thermal influence to the sensitive material layer to elevate the productivity. Since the alcohol or the water is employed, the environmental safety and the relatively easy treatment can be secured and the environmental problems recently recognized are suitably avoidable.

A more concrete and suitable solvent is a mixed solvent of isopropyl alcohol and methanol. The isopropyl alcohol is excellent in wettability and is suitable for applying a thin film (about 0.5 to 3 $\mu$m) of the over coating layer to a large area. By mixing the isopropyl alcohol with the methanol excellent in the dispersing ability of the composition mainly containing the silica particles, the organic compound chemically bonded thereto and the photo-polymerization initiator, the coating material can be stably preserved to reduce the drying speed in the preparation of the over coating layer compared with the case only isopropyl alcohol is employed. Since the isopropyl alcohol makes an azeotropic mixture with water to remove the water at a lower temperature, moisture affecting the electrophoto characteristics is not left at the preparation of the over coating layer for stabilizing the manufactured sensitive material as well as for preventing the lowering of the above characteristics.

The first organic solvent includes dichloromethane, tetrahydrofuran and methyl ethylketone, and the second organic solvent includes an alcohol such as isopropyl alcohol, methyl alcohol and ethyl alcohol, and water.

The first organic solvent is preferably tetrahydrofuran, and the second organic solvent is preferably methanol. The tetrahydrofuran easily dissolves the charge transport material and is excellent in the compatibility with an alcohol. Even when the tetrahyrdofuran is diluted with an alcohol after the charge transport material is once dissolved in the tetrahydrofuran, the stable dilution of the charge transport material under a condition of stable solvation can be realized to achieve the high concentration in the alcohol. The methanol is contained in the photo-setting coating material stock solution and does not precipitate the composition of the photo-setting coating material. Since the methanol is easily mixed with the tetrahyrdofuran, the stable over coating layer coating material can be prepared.

The charge transport material is added to the over coating layer 14 of the photoreceptor for electrophotography of this Embodiment in order to elevate the electrophoto characteristics. A proper amount of the charge transport material must be added in the coating material that is employed for forming the over coating layer 14.

In most cases, the over coating layer 14 is industrially prepared by means of a dip-coating method. In the procedures for manufacturing the layered sensitive material 10 shown in FIG. 1, the charge transport material is dissolved at the time of the dip-coating of the over coating layer from the charge transport layer into the organic solvent which has been employed for applying the coating material on the over coating layer 14. The over coating layer coating material is required to have contradictory properties such that the coating material dissolves a proper amount of the charge transport material and at the time of forming the over coating layer the coating material does not dissolve the charge transport material from the charge transport layer 13.

In order to satisfy this request, a thick solution is prepared at the charge transport material pre-dispersion step S1A and then a proper amount of the thick solution is diluted in an organic solvent in which the charge transport material is hardly dissolved at the charge transport coating material dispersion step S1B. The coating material preparation according to the procedure prevents the dissolution of the charge transport material from the charge transport layer at the time of forming the over coating layer and realizes the over coating layer coating material which enables the compatible dissolution of a suitable amount of the charge transport material in the over coating layer 14.

In the applying step S2, the thus prepared surface protective coating material is applied on the sensitive material which has been formed by layering the charge generation layer 12 and the charge transport layer 13 in this turn on the electroconductive substrate (supporting substrate) 11. An applying method includes a dip coating, a spray coating, a blade coating and a ring coating.

In the solvent drying step S3, the solvent which has been included in the over coating layer coating material is dried by employing a high temperature drier and a vacuum drier. A temperature for the drying is between a room temperature and that at which the sensitive material having the applied coating material is not denaturalized, and generally between 60 and 150° C.

In the ultraviolet ray curing step S4, the ultraviolet ray irradiation is conducted onto the coating film from which the solvent has been removed by the drying to cure the over coating layer coating material. A preferable wavelength of the ultraviolet ray for curing depends on the photo-polymerization initiator, and a low-pressure mercury lamp, a high-pressure mercury lamp and a xenon lamp are employed as a light source.

A wavelength of 310 nm or less is mainly employed in the present invention as that of the curing ultraviolet ray. The ultraviolet ray is absorbed as much as possible at the neighborhood of the surface by employing that having a high absorption coefficient concerning the organic material.

Since a photo-isomerization reaction or a photo-decomposition reaction occurs in the organic material by the irradiated ultraviolet ray, the deterioration, the lowering of the performances and the photo-memory effect of the organic sensitive material are generated when the photo-setting coating material is employed. The lowering of the performances of the organic sensitive material due to the ultraviolet ray is prevented by absorbing the ultraviolet ray at the neighborhood of the organic sensitive material at the time of the curing of the photo-setting coating material, and consequently the photoreceptor for electrophotgraphy 10 having the excellent electrophoto characteristics and the excellent durability can be manufactured. An excimer laser and a low pressure mercury lamp having main radiation wavelengths of 254.7 nm and 184.9 nm are known as the light source of the ultraviolet ray having the wavelength of 310 nm or less. The low-pressure mercury lamp is suitable for the manufacture of the photoreceptor for electrophotgraphy 10 in which the irradiation must be conducted to a relatively large area.

The above method of manufacturing the over coating layer 14 provides the photo-setting over coating layer 14 having the added charge transport material, the excellent electrophoto characteristics and the high durabilities. A suitable thickness of the over coating layer 14 changes depending on a development system and required performances and it is generally 10 μm or less, and preferably between 0.5 and 5 μm in the contact development system. When the thickness of the over coating layer for the sensitive material requiring a large area is 0.5 μm or less, the preparation of a layer having a uniform thickness which produces no image irregularity is difficult and the durability and the resistance to printing to a development roller and paper are decreased. When, on the other hand, the thickness exceeds 5 μm, the electrophoto characteristics are considerably lowered, or problems such as increase of a residual potential and decrease of sensitivity may be concretely generated to make the sensitivity material impracticable.

Although Examples of the present invention will be described, the present invention shall not be restricted thereto.

Example 1

A planar aluminum substrate 11 was dipped in a liquid prepared by dissolving a charge generation substance (titanium oxide phthalocyanine) and bonding resin (butylal resin) into a tetrahydrofuran (THF) solvent to make a coating film having a dry thickness of about 0.25 μm on the substrate.

A charge transport layer coating material was prepared by dissolving a charge transport material having a below structure (bis-triphenyl amine styryl compound) and bonding resin (polycarbonate, tradename: Z200, available from Mitsubishi Gas Chemical Co.) into the THF solvent. The coating material was applied on the charge generation layer 12 formerly prepared to make a coating film which was a charge transport layer 13 having a dry thickness of about 20 μm by means of a dipping method.

Formula 5

Bis-triphenlamine styryl compound

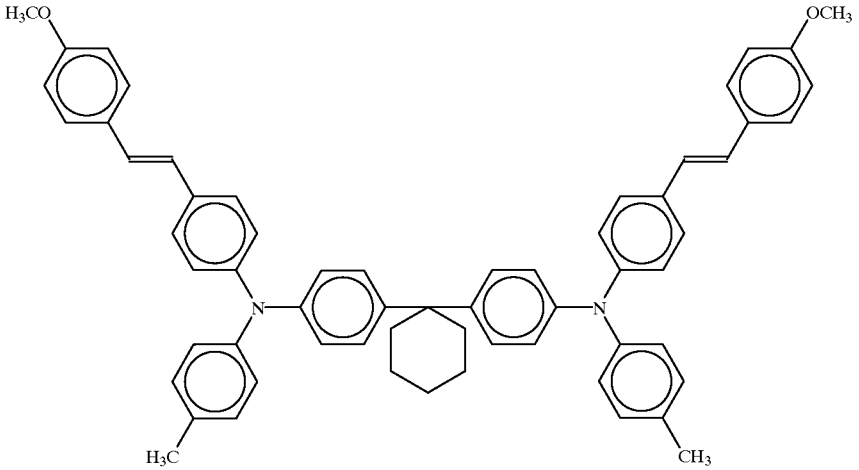

Then, preparation of the over coating layer 14 will be described in detail.

At first, 1 weight part of the charge transport material (bis-triphenyl amine styryl compound) the same as that employed in the charge transport layer was dissolved into 10 weight parts of the THF solvent under sufficient agitation (charge transport material pre-dispersion step S1A). The thick solution of the charge transport material thus obtained was diluted and dispersed in 40 weight parts of isopropyl alcohol. Then, 50 weight parts of Desolite Z 7501 (JSR Corporation) which was a coating stock solution (solvent: methyl ethyl ketone) containing a composition mainly containing silica particles, an organic compound chemically bonded thereto and a photo-polymerization initiator was added to the diluted solution under sufficient agitation to form an over coating layer coating material (charge transport coating material dispersion step S1B). In the over coating layer coating material thus obtained, the charge transport material was completely dissolved and no precipitation was observed.

The over coating layer coating material thus obtained was dipped and applied on the charge transport layer 13 of the sensitive material (applying step S2). The sensitive material was dried at 90° C. for 20 min. (solvent drying step S3) and irradiated with an ultraviolet ray for 1 min. employing a low pressure mercury lamp (ultraviolet ray curing step S4) to form the over coating layer 14 having a thickness of about 1 μm. The curing of the over coating layer 14 and the adhesion property with the charge transport layer 13 were confirmed by means of a scratch test of the over coating layer 14 to obtain the planar photoreceptor for electrophotgraphy 10 of the present invention. No cracks were observed on the surfaces of the charge generation layer 12, of the charge transport layer 13 and of the over coating layer 14 of the photoreceptor for electrophotography thus obtained. Clouding and crystallization in the respective layers were not observed.

Example 2

The sensitive material having the charge transport layer 13 prepared in accordance with the conditions similar to those of Example 1 was dipped in the over coating layer coating material which was the same as that of Example 1 to form the over coating layer 14. In this instance, the over coating layer 14 was prepared by controlling the pull-up speed in the dipping step to obtain a dry thickness of 3 μm. No cracks were observed on the surfaces of the charge generation layer 12, of the charge transport layer 13 and of the over coating layer 14 of the photoreceptor for electrophotography thus obtained. Clouding and crystallization in the respective layers were not observed.

Example 3

The sensitive material having the charge transport layer 13 prepared in accordance with the conditions similar to those of Example 1 was dipped in the over coating layer coating material which was the same as that of Example 1 to form the over coating layer 14. In this instance, the over coating layer 14 was prepared by controlling the pull-up speed in the dipping step to obtain a dry thickness of 5 μm. No cracks were observed on the surfaces of the charge generation layer 12, of the charge transport layer 13 and of the over coating layer 14 of the photoreceptor for electrophotography thus obtained. Clouding and crystallization in the respective layers were not observed.

Example 4

The sensitive material having the charge transport layer 13 prepared in accordance with the conditions similar to those of Example 1 was dipped in the over coating layer coating material which was the same as that of Example 1 to form the over coating layer 14. In this instance, the over coating layer 14 was prepared by controlling the pull-up speed in the dipping step to obtain a dry thickness of 10 μm. No cracks were observed on the surfaces of the charge generation layer 12, of the charge transport layer 13 and of the over coating layer 14 of the photoreceptor for electrophotography thus obtained. Clouding and crystallization in the respective layers were not observed.

Example 5

The photoreceptor for electrophotgraphy 10 was obtained under the same conditions as those of Example 1 except that 0.5 weight part of the charge transport material (bis-triphenylamine styryl compound) was employed in place of 1 weight part thereof in Example 1 to form the over coating layer 14. No cracks were observed on the surfaces of the charge generation layer 12, of the charge transport layer 13 and of the over coating layer 14 of the photoreceptor for electrophotography thus obtained. Clouding and crystallization in the respective layers were not observed.

Example 6

The photoreceptor for electrophotgraphy 10 was obtained under the same conditions as those of Example 1 except that 0.1 weight part of the charge transport material (bis-triphenylamine styryl compound) was employed in place of 1 weight part thereof in Example 1. No cracks were observed on the surfaces of the charge generation layer 12, of the charge transport layer 13 and of the over coating layer 14 of the photoreceptor for electrophotography thus obtained.

Example 7

The photoreceptor for electrophotgraphy 10 was obtained under the same conditions as those of Example 1 except that 0.1 weight part of the charge transport material of the below structure (triphenylamine compound) was employed in place of 1 weight part of the bis-triphenylamine styryl compound in Example 1.

Formula 6

Triphenylamine Compound

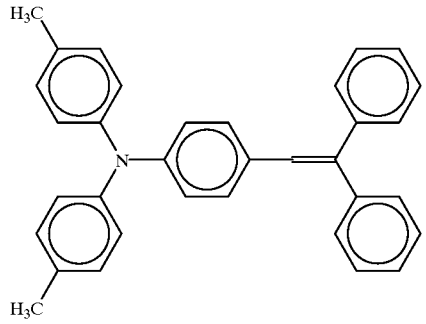

Comparative Example 1

Photoreceptor for electrophotography in which over coating layer was prepared by simply mixed coating material The photoreceptor for electrophotgraphy 10 was obtained under the same conditions as those of Example 1 except that an over coating layer coating material prepared by mixing 2 weight parts of the charge transport material (bis-triphenylamine styryl compound), 10 weight parts of THF, 50 weight parts of IPA (isopropyl alcohol) and 50 weight parts of Desolite Z7501 and dissolving the material in the THF and IPA solvents under agitation for a time period the same as that of Example 1 was employed. An over coating layer 14 was formed on the charge transport layer 13 under the same conditions as those of Example 1 in connection with the dip application, the solvent drying and the ultra-violet ray curing. In the over coating layer coating material thus prepared, the charge transport material was not completely dissolved. The charge transport material prepared in accordance with this method was precipitated on the surface of the over coating layer 14 of the photoreceptor for electrophotography, and this photoreceptor for electrophotography was a defective.

Comparative Example 2

Photoreceptor for electrophotography in which_over coating layer was prepared by over coating layer coating material employing only first solvent THF The over coating layer 14 was obtained under the same conditions as those of Example 1 except that an over coating layer coating material prepared by sufficiently dissolving 1 weight part of the charge transport material (the bis-triphenylamine styryl compound) in 60 weight parts of THF under agitation followed by the addition of 50 weight parts of Desolite Z7501 (JSR Corporation) under agitation. In the over coating layer coating material, the charge transport material was completely dissolved and was not precipitated. However, the over coating layer 14 of the photoreceptor for electrophotography prepared by employing the above over coating layer coating material was clouded at the time of the solvent drying and this photoreceptor for electrophotography was a defective.

Comparative Example 3

Photoreceptor for electrophotography in which no charge transport material is added to over coating layer The photoreceptor for electrophotgraphy 10 for comparison was obtained under the same conditions as those of Example 1 except that the charge transport material (the bis-triphenylamine styryl compound) was not added. No cracks were observed on the surfaces of the charge generation layer 12, of the charge transport layer 13 and of the over coating layer 14 of the photoreceptor for electrophotography thus obtained. The electrophoto characteristics of the planar photoreceptor for electrophotgraphy 10 of Examples 1 to 7 and Comparative Examples 1 to 3 were evaluated employing an Electrostatic Power Analyzer (EPA-8100, Kawaguchi Electric Works, Ltd.) which measures behaviors of a surface potential of a sensitive material after repeated processes of charging-exposure-static elimination under the measurement conditions of −5kV of a corona charged voltage and 5 Lux of a white exposure and under a room temperature and a normal pressure. The results were summarized in Table 1. As shown therein, the photoreceptor for electrophotgraphy 10 of Examples 1 to 7 have excellent electrophoto characteristics.

TABLE 1

| | Sensitivity (Lux.sec) | Residual potential (V) | Thickness of Protective Layer(μm) | Addition Concentration (%) |
|---|---|---|---|---|
| Example 1 | 0.231 | −10 | 1 | 1 |
| Example 2 | 0.231 | −20 | 3 | 5 |
| Example 3 | 0.244 | −40 | 5 | 5 |
| Example 4 | 0.265 | −84 | 10 | 1 |
| Example 5 | 0.235 | −19 | 1 | 0.5 |
| Example 6 | 0.231 | −68 | 1 | 0.1 |
| Example 7 | 0.231 | −18 | 1 | 0.5 |
| Comp. Ex. 1 | 0.444 | −150 or more | 1 | 1 |
| Comp. Ex. 2 | non-measurable | −500 or more | 1 | 1 |
| Comp. Ex. 3 | 0.299 | −250 or more | 1 | 0 |

Example 8

An over coating layer coating material having a charge transport material added thereto at a similar formulation rate to that of Example 1 was applied on a disc-like aluminum substrate having thereon a charge transport layer 13 of which a thickness was about 30 μm. Materials and a formulation rate of the charge transport layer were similar to those of Example 1. After the solvent drying at 90° C. for 20 min., an over coating layer 14 was formed by means of ultraviolet ray curing by employing a low pressure mercury lamp to manufacture a disc-like abrasion test substrate. By employing a Taber abrasion tester (TABER INDUSTRIES, abrading wheel: MS-10, load weight: 500 g, 1000 rounds), an abrasion amount was evaluated to be 0.5 μm or less which was an excellent result.

Comparative Example 4

A charge transport layer 13 having a thickness of about 30 μm and materials and a formulation rate which were similar to those of Example 1 was formed on a disc-like aluminum substrate to prepare a disc-like abrasion test substrate. A similar abrasion test to that of Example 8 was conducted, and an abrasion amount was 8 μm or more which was a bad result.

After samples in which formulation rates of the charge transport materials in the over coating layers were changed were prepared in accordance with similar procedures to those of Example 8, abrasion amounts of the samples were evaluated under the same conditions.

Figure 3:
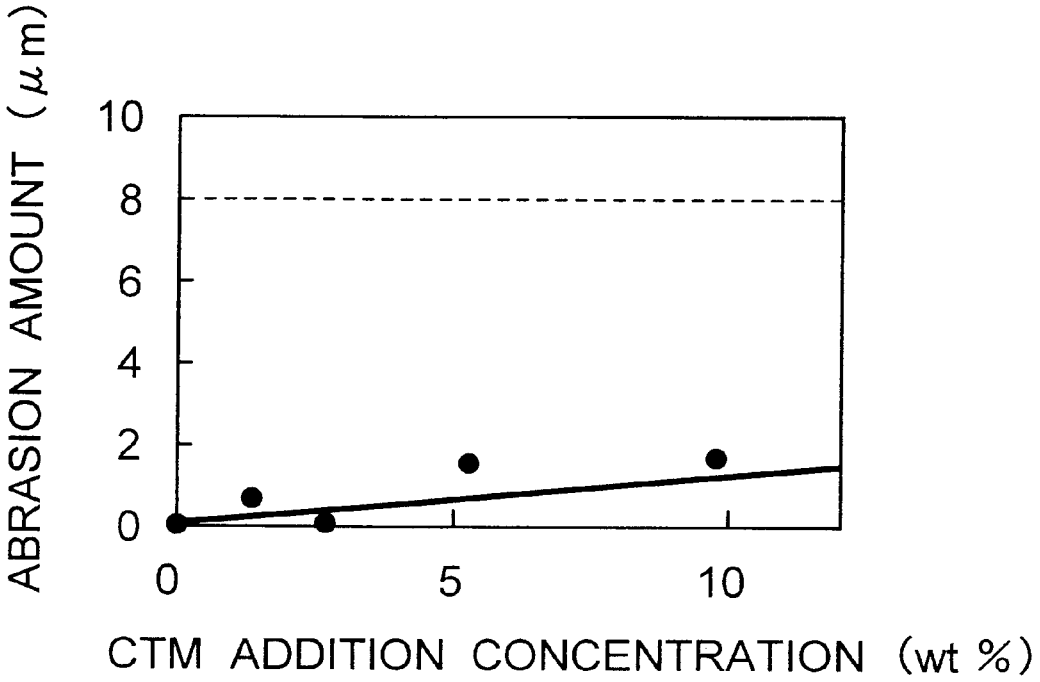
FIG. 3 is a graph showing results of an abrasion test conducted in Examples.

FIG. 3 shows the evaluation results of the abrasion amounts to the charge transport material addition concentration (CTM addition concentration) in the over coating layer. In the sensitive material employing the over coating layer, little abrasion was observed under the measurement conditions of the abrasion test, and its hardwearing property was remarkably elevated compared with the conventional charge transport layer (Comparative Example 4). Even if the charge transport material addition concentration was 10%, the abrasion amount of the over coating layer was 2 μm or less and accordingly the sensitive material had the excellent hardwearing property.

Example 9

A planar aluminum substrate 11 was dipped in a liquid prepared by dissolving a charge generation substance (titanium oxide phthalocyanine) and bonding resin (butylal resin) into a tetrahydrofuran (THF) solvent to make a coating film having a dry thickness of about 0.25 μm on the substrate.

A charge transport layer coating material was prepared by dissolving a charge transport material having a below structure (bis-triphenyl amine styryl compound) and bonding resin (polycarbonate, tradename: Z200, available from Mitsubishi Gas Chemical Co.) into the THF solvent. The coating material was applied on the charge generation layer 12 formerly prepared to make a coating film which was a charge transport layer 13 having a dry thickness of about 20 μm by means of a dipping method.

Formula 6

Bis-triphenlamine styryl compound

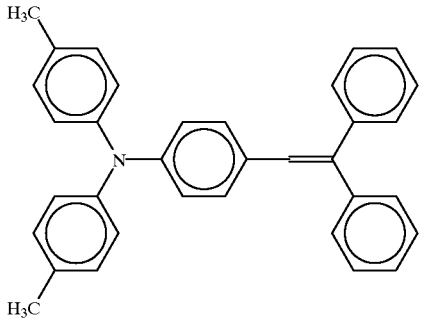

Then, preparation of the over coating layer 14 will be described in detail.

At first, 1 weight part of the charge transport material (bis-triphenyl amine styryl compound) the same as that employed in the charge transport layer was dissolved into 10 weight parts of the THF solvent under sufficient agitation (charge transport material pre-dispersion step S1A). The thick solution of the charge transport material thus obtained was diluted and dispersed in 40 weight parts of isopropyl alcohol. Then, 50 weight parts of Desolite KZ 7861 (JSR Corporation) which was a coating stock solution prepared by diluting and dispersing a composition mainly containing silica particles, an organic compound chemically bonded thereto and a photo-polymerization initiator into a mixed solvent consisting of isopropyl alcohol and methyl ethyl ketone in ratio of 1:1 was added to the diluted solution under sufficient agitation to form an over coating layer coating material (charge transport coating material dispersion step S1B). In the over coating layer coating material thus obtained, the charge transport material completely dissolved and no precipitation was observed.

The over coating layer coating material thus obtained was dipped and applied on the charge transport layer 13 of the sensitive material (applying step S2). The sensitive material was dried at 90° C. for 20 min. (solvent drying step S3) and irradiated with an ultraviolet ray for 1 min. employing a low pressure mercury lamp (ultraviolet ray curing step S3) to form the over coating layer 14 having a thickness of about 1 μm. The curing of the over coating layer 14 and the adhesion property with the charge transport layer 14 were confirmed by means of a scratch test of the over coating layer 14 to obtain the planar photoreceptor for electrophotography of the present invention. No cracks were observed on the surfaces of the charge generation layer 12, of the charge transport layer 13 and of the over coating layer 14 of the photoreceptor for electrophotography thus obtained. Clouding and crystallization in the respective layers were not observed.

A sensitive material drum having the photoreceptor for electrophotography prepared in this Example was manufactured and mounted on a printer PR1000 available from NEC Corporation. As a result of the printing employing the printer, excellent images could be obtained. Further, a running test of repeated printings were conducted to find out that the over coating layer had a resistance to printing three times or more better than that of a sensitive material drum having no over coating layer.

Example 10

Photoreceptor for electrophotography in which no charge transport material is added to over coating layer The photoreceptor for electrophotgraphy 10 for comparison was obtained under the same conditions as those of Example 9 except that the charge transport material (the bis-triphenylamine styryl compound) was not added. No cracks were observed on the surfaces of the charge generation layer 12, of the charge transport layer 13 and of the over coating layer 14 of the photoreceptor for electrophotography thus obtained.

The electrophoto characteristics of the planar photoreceptor for electrophotgraphy 10 of Examples 9 and 10 were evaluated employing the above Electrostatic Power Analyzer (EPA-8100, Kawaguchi Electric Works, Ltd.) under the measurement conditions of −5kV of a corona charged voltage and 5 Lux of a white exposure and under a room temperature and a normal pressure. The results were summarized in Table 2. As shown therein, the photoreceptor for electrophotgraphy 10 of Examples 9 and 10 have excellent electrophoto characteristics.

TABLE 2

| | Sensitivity (Lux.sec) | Residual Potential (V) | Thickness of Protective Layer (μm) | Addition Concentration (%) |
|---|---|---|---|---|
| Example 9 | 0.230 | −15 | 1 | 1 |
| Example 10 | 0.250 | about −50 | 1 | 0 |

Example 11

An over coating layer coating material having a charge transport material added thereto at a similar formulation rate to that of Example 9 was applied on a disc-like aluminum substrate having thereon a charge transport layer 13 of which a thickness was about 30 μm to make an over coating layer 14. Materials and a formulation rate of the charge transport layer were similar to those of Example 1. After the solvent drying at 90° C. for 20 min., the over coating layer 14 was formed by means of ultraviolet ray curing by employing a low pressure mercury lamp to manufacture a disc-like abrasion test substrate. By employing the Taber abrasion tester (TABER INDUSTRIES, abrasion wheel: MS-10, load weight: 500 g, 1000 rounds), an abrasion amount was evaluated to be 0.5 μm or less which was an excellent result.

Comparative Example 5

A charge transport layer 13 having a thickness of about 30 μm and materials and a formulation rate which were similar to those of Example 9 was formed on a disc-like aluminum substrate to prepare a disc-like abrasion test substrate. A similar abrasion test to that of Example 3 was conducted, and an abrasion amount was 8 μm or more which was a bad result.

Since the above embodiments are described only for examples, the present invention is not limited to the above embodiments and various modifications or alternations can be easily made therefrom by those skilled in the art without departing from the scope of the present invention.

What is claimed is:

1. A photoreceptor for electrophotography comprising:

a substrate; and an over coating layer formed on said substrate by applying a composition containing silica particles, an organic compound bonded said silica particles and a photo polymerization initiator and by curing said composition;

said silica particles and said organic compound being bonded with each other through a silyloxy group;

said organic compound having at least one group selected from the group consisting of a polymerizable unsaturated group, a group designated by Formula (1) and a group designated by Formula (2);

Formula (1)

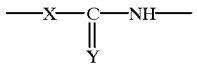

Formula (2)

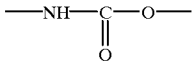

wherein —X— is selected from —NH—, —O— and —S—, —Y— is an oxygen atom or a sulfur atom, and when —X— is —O—, Y is said sulfur atom.

2. The photoreceptor for electrophotography as defined in claim 1, wherein said over coating layer contains 0.01 to 10% in weight of a charge transport material.

3. The photoreceptor for electrophotography as defined in claim 1, wherein the thickness of said over coating layer is between 0.5 and 10 $\mu$m.

4. The photoreceptor for electrophotography as defined in claim 1, wherein said composition is diluted by and dispersed in a solvent of which a main component is water or an alcohol having a boiling point of 120° C. or less in a specified concentration range to prepare a photosetting coating material that is applied and cured to form said over coating layer.

5. The photoreceptor for electrophotography as defined in claim 4, wherein said composition is diluted by and dispersed in a solvent of which a main component is methanol and isopropyl alcohol mixed with each other at a specified rate.

6. A method for manufacturing a photoreceptor for electrophotography defined in claim 2 comprising the steps of:

dissolving a charge transport material into a first organic solvent other than alcohols which dissolves said charge transport material at 0.5% in weight or more, diluting said first organic solvent having said charge transport material dissolved therein with an alcoholic second organic solvent at a specified rate, dispersing a composition containing silica particles, an organic compound chemically bonded thereto and a photo polymerization initiator in the diluted organic solvent to prepare an over coating layer coating material, said organic compound having at least one group selected from a group consisting of a polymerizable unsaturated group, a group designated by Formula (1) and a group designated by Formula (2), and said silica particles and said organic compound being bonded with each other through a silyloxy group, Formula (1)

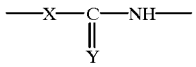

Formula (2)

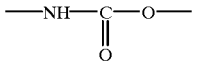

wherein —X— is selected from —NH—, —O— and —S—, —Y— is an oxygen atom or a sulfur atom, and when —X— is —O—, Y is said sulfur atom, and applying said over coating layer coating material for forming an over coating layer.

7. A method for manufacturing a photoreceptor for electrophotography defined in claim 2 comprising the steps of:

dissolving a charge transport material into a first organic solvent other than alcohols which dissolves said charge transport material at 0.5% in weight or more, diluting said first organic solvent having said charge transport material dissolved therein with an alcoholic second organic solvent at a specified rate, dispersing a composition containing silica particles, an organic compound chemically bonded thereto and a photo polymerization initiator in said diluted organic solvent to prepare an over coating layer coating material, said organic compound having at least one group selected from a group consisting of a polymerizable unsaturated group, a group designated by Formula (1) and a group designated by Formula (2), and said silica particles and said organic compound being bonded with each other through a silyloxy group, Formula (1)

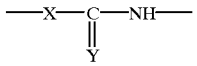

Formula (2)

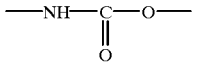

wherein —X— is selected from —NH—, —O— and —S—, —Y— is an oxygen atom or a sulfur atom, and when —X— is —O—, Y is said sulfur atom, applying said over coating layer coating material, and irradiating said over coating layer coating material with an ultraviolet ray having a wavelength of mainly 310 nm or less to dry and cure said coating material for forming an over coating layer.

* * * * *